United States Patent [19]

Simon

[11] 4,118,879

[45] Oct. 10, 1978

[54] ANIMATED DISPLAY DEVICE HAVING A CURVED PLATEN AND A MOVABLE FILM

[75] Inventor: Virgil S. Simon, Glenview, Ill.

[73] Assignee: Thomas A. Schutz Co., Inc., Morton Grove, Ill.

[21] Appl. No.: 767,492

[22] Filed: Feb. 10, 1977

[51] Int. Cl.[2] ..... G09F 13/34; G09F 19/14

[52] U.S. Cl. ..... 40/437; 40/476; 74/66

[58] Field of Search ..... 40/106.51–106.53, 40/137, 30, 36, 437, 476; 74/66, 55, 68, 88

[56] References Cited

U.S. PATENT DOCUMENTS

| | | | |
|---|---|---|---|
| 1,888,527 | 11/1932 | Edouart | 352/97 |
| 2,506,135 | 5/1950 | Burchell | 272/8 R X |
| 2,956,359 | 10/1960 | Smith et al. | 40/106.53 X |
| 3,421,805 | 1/1969 | Rowland | 40/137 |
| 3,683,525 | 8/1972 | Fukui | 40/137 |
| 3,862,504 | 1/1975 | Ringelheim et al. | 40/106.53 |
| 3,918,185 | 11/1975 | Hasala | 40/106.53 |

*Primary Examiner*—John F. Pitrelli

*Attorney, Agent, or Firm*—Wegner, Stellman, McCord, Wiles & Wood

[57] ABSTRACT

An animated display device having illuminating means for projecting uniformly diffused light toward a viewer and means between said illuminating means and the viewer for providing an animated display including a rigid platen having a convex surface with sections of transparent and opaque character, a flexible sheet of film in contact with the convex surface and having translucent images thereon, resilient means tensioning the film over and in full surface contact with the convex platen surface, and a drive mechanism for shifting said film and said platen relative to one another. An adjustment mechanism is associated with the drive mechanism to facilitate angular alignment of the film relative to the platen.

7 Claims, 2 Drawing Figures

ANIMATED DISPLAY DEVICE HAVING A CURVED PLATEN AND A MOVABLE FILM

BACKGROUND OF THE INVENTION

This invention relates generally to an animated display device and, more particularly, to an illuminated display device having a movable film giving the illusion of motion or providing for shifting scenes. "Animated display" is used herein generally to cover both an illusion of motion and a shifting scene.

Animated display devices are well-known in the art. Such devices usually include a shutter film or grid sheet having alternate opaque and transparent strips, an overlying translucent program film having an image thereon, and an illuminating means for generating light which passes through the transparent sections of the shutter film and the program film so as to project a visible image. The program film has a series of strip images so that when the film is moved relative to the shutter film, one of the images is visible during a discrete time interval.

In the prior art, it has been a common practice to utilize a relatively thin flexible sheet for the shutter film and a similar sheet for the program film, since the use of photographic films can expedite manufacture and since the use of movable, rigid, platelike sheets can create special mounting problems.

To avoid parallax, it is necessary that the sheets be held firmly together. A rather costly and intricate method for maintaining the thin sheets together is to mount them between two rigid transparent plates. Magnetic strips have been proposed. In another device, sheets were to be maintained in contact by freely supporting them in facing relationship with the edges of the forward sheet being urged rearwardly and the edges of the rearward sheet being urged forwardly. This practice maintains the edges of the sheets in contact; however, maintaining the center portions of the sheets in contact remains a problem, particularly where differential shrinking of the sheets is encountered.

SUMMARY OF THE INVENTION

It is the principal object of the present invention to provide an animated display device in which the shutter film and the program film are continuously maintained in complete contact with each other.

In accordance with the invention, a rigid platen having a convex surface and carrying the shutter film is mounted within a housing and the flexible program film is disposed in facing contact with the convex surface of the platen. Tensioning means acting at opposite edges of the program film tension it over and in full surface contact with the convex surface of the platen. Drive means are provided for moving the program film relative to the platen so as to alter the alignment of the shutter film and program film to change the image projected by the device.

As shown herein, the shutter film (grid sheet) is fixed relative to the platen or integral therewith and the program (image) film is movably positioned against the platen. It should be obvious, however, that this relationship may be reversed so that the program film is fixed to or integral with the platen and the shutter film is movably positioned adjacent the platen.

In an exemplary embodiment of the invention, tension springs are connected between the respective edge margins of the program film and to the housing at a point lying generally on a plane containing a chord of the convex surface. The springs thus bias the program film to a tensioned position around the corresponding margins of the platen.

In a preferred embodiment, a parallel linkage includes cam-operated bell cranks linked to one edge of the program film so that during selected positions of a motor-driven cam, the program film is moved in a direction against the action of the springs connected to the other end of the program film. At other selected positions of the cam, the reaction of the springs at the other edge of the program film is operative to move the film in the opposite direction. As a result, the program film is reciprocated relative to the shutter film carried by the platen.

A feature of the invention is the inclusion of an adjustable alignment mechanism associated with one of the bell cranks. The adjustable alignment mechanism includes an adjustment screw which changes the angle between the two arms of the bell crank so as to modify the angular position of the program film relative to the platen.

DESCRIPTION OF THE PREFERRED EMBODIMENT

Figure 1:
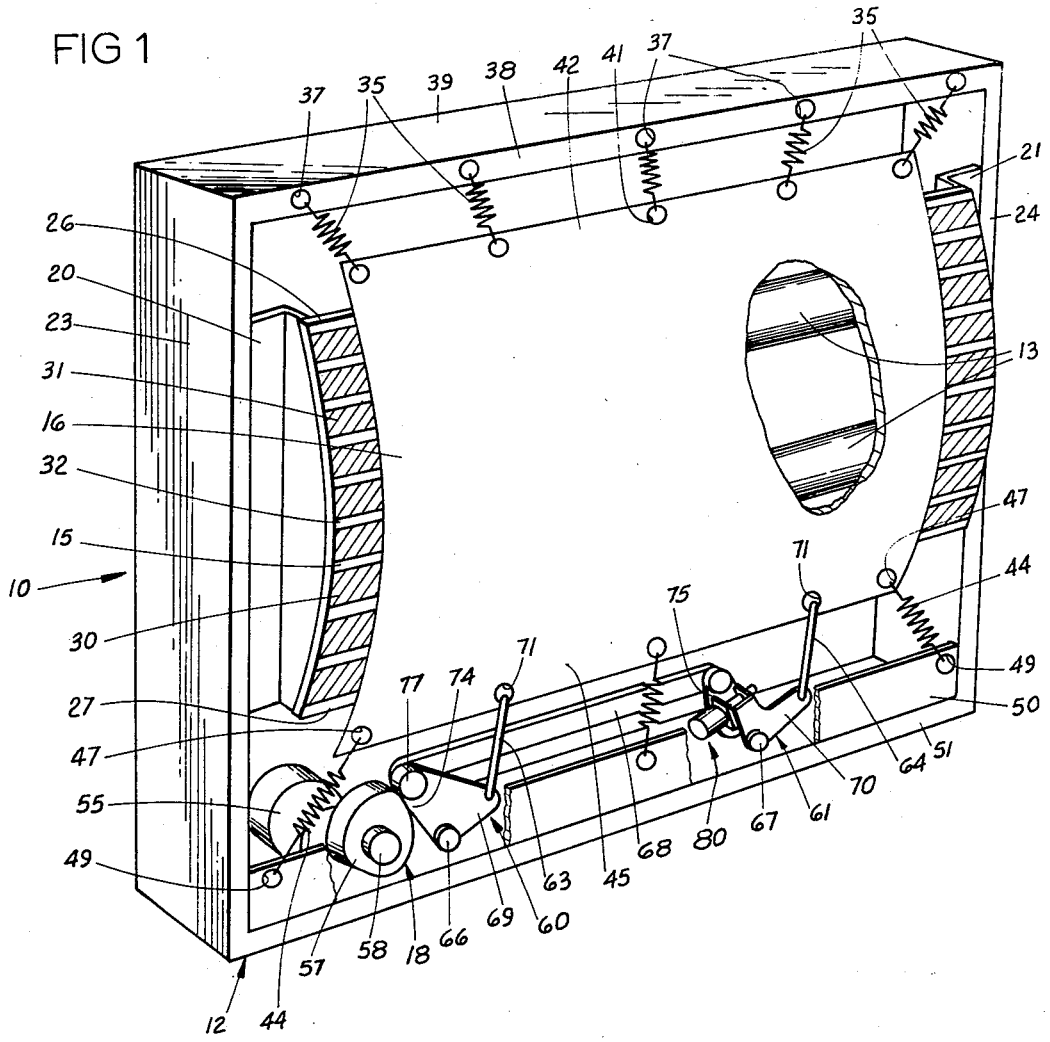
FIG. 1 is a perspective view of an animated display device incorporating the invention having the forward portion of the housing broken away to show the curved platen, the spring-supported film and the cam-operated drive mechanism.
Figure 2:
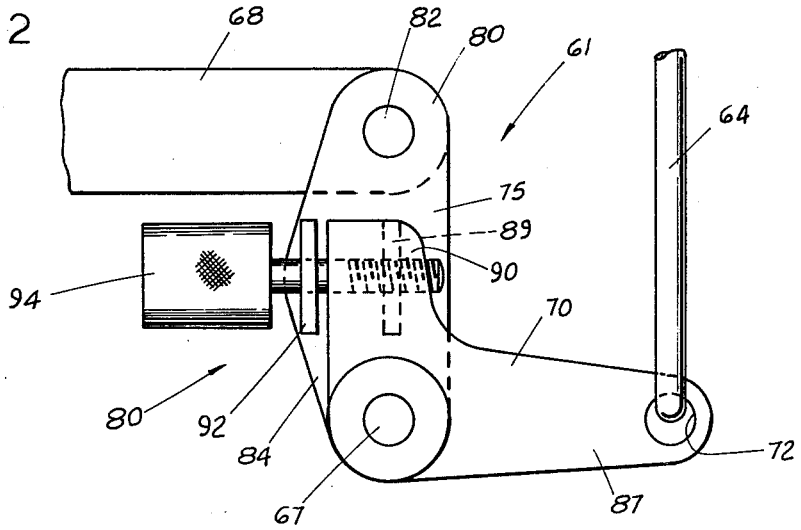
FIG. 2 is an enlarged fragmentary plan view of one of the bell crank levers in which an adjustment mechanism is incorporated.

Referring to FIG. 1, the display device, generally designated 10, is seen to consist generally of a housing 12; illuminating means, such as fluorescent tubes 13; a curved rigid platen 15; a thin sheet of flexible film 16; and a drive mechanism, generally designated 18.

The platen 15 generally extends across the width of the housing 12 and is supported therein by a pair of oppositely disposed brackets 20 and 21 which extend laterally inward from respective side walls 23 and 24 of the housing 12. The platen 15 has upper and lower parallel margins 26 and 27, respectively, and an arcuate, convex surface 30 which curves forwardly from the margins 26 and 27. Preferably, the convex surface 30 has a cylindrical surface configuration with the platen 15 being of uniform thickness. The platen 15 has on the surface 30 a grid comprised of alternate opaque and transparent sections, designated 31 and 32, respectively, so that light from the illuminating fluorescent tubes 13 will only pass through the transparent sections 32 of the platen 15. The widths of the grid strips 31 and 32 is exaggerated in FIG. 1. Actual dimensions are taught in Hasala U.S. Pat. No. 3,918,185.

The program film 16, which may be a strip image color photographic transparency, is in facing contact with the convex surface 30 of the platen 15. Tension springs 35 extending downwardly and forwardly from apertures 37 formed in an inwardly extending flange 38 depending from the top wall 39 of the housing 12 to apertures 41 formed in the upper edge margin 42 of the film 16 suitably bias the film 16 upwardly and rearwardly. Similarly, tension springs 44 are connected to the lower edge margin 45 of the film 16 and extend rearwardly and downwardly from apertures 47 formed in the lower edge margin 45 to apertures 49 formed in a flange 50 extending upwardly from the bottom wall 51 of the housing 12. The housing apertures 37 and 49 each lie generally in a plane containing a chord of the convex surface 30. As a result of the action of the spring 35 and 44, the film 16 is retained against the margins 26 and 27 of the platen 15 so that the film 16 is tensioned at all points against the convex surface 30 so as to avoid parallax.

The drive mechanism 18 includes an electric motor 55, a cam 57 rotated by the motor 55 via shaft 58, similar bell crank levers 60 and 61, and links 63 and 64 extending between the respective bell cranks 60 and 61 and the film 16. The bell cranks 60 and 61 have fulcrums in the housing in the form of pivot pins 66 and 67, respectively. The bell cranks 60 and 61 are driven in unison by an interconnecting link 68 extending between corresponding arm portions 74 and 75 of the respective bell cranks 60 and 61. The links 63 and 64, which may be wire connectors, extend between apertures 71 formed in the lower edge margin 45 of the film 16 and apertures 72 formed in the arm portions 69 and 70 of the respective bell cranks 60 and 61 opposite the link 68. The arm 74 of the bell crank 60 carries a cam follower, such as roller 77, which is urged into riding engagement with the cam 57 by the action of the upper springs 35 acting through the film 16 and the link 63.

An alignment adjustment mechanism, generally designated 80, is associated with the bell crank 61 to permit adjustment of the angular disposition of the film 16 relative to the platen 15. The arm 75 of the bell crank 61 has one end 80 pivotally connected to the link 68 by pin 82 and its other end 84 pivotally mounted on the pin 67. The L-shaped arm 70 of the bell crank 61 is pivotally supported by fulcrum pin 67. The arm 70 has the link 64 connected at its end 87 via the aperture 72 and has a flange 89 extending from its other end 90 which overlies the arm 75. The arm 75 has a corresponding flange 92 which is aligned with and faces the flange 89. Extending between and interconnecting the respective flanges 89 and 92 is an adjustment screw 94 impaled therebetween. By appropriately rotating the adjustment screw 94, the respective flanges 89 and 92 may be moved together or apart so that the angle between the arms 70 and 75 may be adjusted thereby moving the right end of the film 16 upwardly or downwardly to change its angular disposition relative to the platen 15.

In operation, the springs 35 maintain the roller 77 against the cam 57 so that as the cam 57 is rotated, the bell cranks 60 and 61 are pivoted about respective pins 66 and 67 so that at selected positions of the cam 57, the film 16 is moved downwardly via links 63 and 64 to extend the springs 35. At other selected positions of the cam 57, the film 16 is moved upwardly via the action of the springs 35 which will be relaxed.

It should be evident that the image projected may easily be modified by changing the program film 16. This is accomplished by detaching the springs 35 and 44 and the links 63 and 64 from the film 16 and mounting a new film. As noted previously, the film 16 can be easily manufactured in quantity by photographic methods. The construction disclosed herein premits the basic unit to be used with any desired program film.

I claim:

1. In an illuminated animated display having a housing, illuminating means within said housing for projecting substantially uniformly diffused light forwardly toward a viewer, a rigid platen between the illuminating means and the viewer, the platen having sections of transparent and opaque character with light from the illuminating means passing through the transparent sections of the platen, a flexible sheet of film having translucent images thereon with only those portions of the images which register with the transparent sections of the platen being illuminated and projected, and tensioning means acting at opposite edges of the film for tensioning it over and in full surface contact with the platen, means for shifting the film and the platen relative to one another, comprising;

a motor;

a single cam rotatively driven by the motor;

similar cranks pivotally mounted in spaced relation adjacent one of said opposite edges of the film;

a link member connecting corresponding portions of said cranks for parallel movement of the cranks;

drive links connecting corresponding portions of said cranks to said one of said opposite edges of the film; and a cam follower on one of said cranks and riding on said cam whereby rotation of said cam pivots said cranks to effect reciprocation of the film thereby extending and relaxing the tensioning means at the other of said opposite edges of the film so as to vary the alignment of the film images with the transparent and opaque sections and intermittently change the projected visual image.

2. The animated display of claim 1 wherein said cranks are bell cranks having angularly related arms, each of said bell cranks having one arm connected to its respective drive link and its other arm connected to the link member.

3. The animated display of claim 2 wherein said bell cranks have a pivot axis perpendicular to said one of said opposite edges of the film and said link member is substantially parallel to said one of said opposite edges.

4. The animated display of claim 2 further including means for adjusting the angular disposition of said film relative to said platen.

5. The animated display of claim 4 in which said means for adjusting the angular disposition of said film relative to said platen is in one of said bell cranks.

6. The animated display of claim 4 wherein one of the bell cranks has its two arms pivotally connected for relative movement in parallel planes, and in which means are provided for adjusting the angle between said arms so as to adjust the angular disposition of the film relative to the platen.

7. The animated display of claim 6 in which the two pivotally connected arms have aligned flanges, and an adjustment screw impales said flanges to adjust the angle between the arms.

* * * * *